US010988296B2

(12) United States Patent
Erickson et al.

(10) Patent No.: US 10,988,296 B2
(45) Date of Patent: Apr. 27, 2021

(54) BARRIER SPOUT

(71) Applicant: Scholle IPN Corporation, Northlake, IL (US)

(72) Inventors: Kyle Erickson, Naperville, IL (US); David Bellmore, DeWitt, MI (US); Paul Van Den Hoonaard, Peachtree City, GA (US)

(73) Assignee: Scholle IPN Corporation, Northlake, IL (US)

( * ) Notice: Subject to any disclaimer, the term of this patent is extended or adjusted under 35 U.S.C. 154(b) by 0 days.

(21) Appl. No.: 16/700,620

(22) Filed: Dec. 2, 2019

(65) Prior Publication Data

US 2020/0231352 A1 Jul. 23, 2020

Related U.S. Application Data

(60) Provisional application No. 62/773,224, filed on Nov. 30, 2018.

(51) Int. Cl.
*B65D 75/58* (2006.01)

(52) U.S. Cl.
CPC ..... *B65D 75/5872* (2013.01); *B65D 2575/58* (2013.01)

(58) Field of Classification Search
CPC ..... B65D 75/5872; B65D 75/58
USPC ..... 222/570
See application file for complete search history.

(56) References Cited

U.S. PATENT DOCUMENTS

| | | | | |
|---|---|---|---|---|
| 6,000,848 | A * | 12/1999 | Massioui | B65D 75/5883 215/306 |
| 6,860,406 | B2 * | 3/2005 | Kobetsky | B29C 65/18 222/92 |
| 9,533,802 | B2 * | 1/2017 | Berge | B65D 75/008 |
| 2006/0201967 | A1 | 9/2006 | Romer | |
| 2014/0097211 | A1 * | 4/2014 | Oates, II | B65D 25/48 222/566 |
| 2017/0008207 | A1 | 1/2017 | Tamarindo | |
| 2017/0088318 | A1 * | 3/2017 | Franca | B65D 47/2031 |
| 2017/0121085 | A1 | 5/2017 | Ichikawa et al. | |
| 2017/0225852 | A1 | 8/2017 | Ohkubo et al. | |

* cited by examiner

*Primary Examiner* — Vishal Pancholi
(74) *Attorney, Agent, or Firm* — The Watson IP Group, PLC; Jovan N. Jovanovic

(57) ABSTRACT

A barrier spout is comprised of a straw and a sealboat. The straw comprises a body having a first straw portion and a second straw portion, with an upper opening of the straw at a first end of the first straw portion and a lower opening of the straw at a second end of the second straw portion, the first straw portion and the second straw portion meeting at a second end of the first straw portion and a first end of the second straw portion. The straw is comprised of a barrier material to minimize at least one of oxygen and vapor transmission through the barrier material. The sealboat comprises a sealing material, the sealboat contacting an inner surface of the sealboat forming a liquid seal between the straw and the sealboat.

16 Claims, 15 Drawing Sheets

BARRIER SPOUT

CROSS-REFERENCE TO RELATED APPLICATION

The present application claims priority from U.S. Provisional Patent Application Ser. No. 62/773,224, filed Nov. 30, 2018, entitled "Barrier Spout", the entire specification of which is hereby incorporated by reference in its entirety.

BACKGROUND OF THE DISCLOSURE

1. Field of the Disclosure

The disclosure relates in general to flexible packaging, and more particularly, to a barrier spout for a flexible bag.

2. Background Art

The use of flexible packaging is known in the art. Often the flexible packaging comprises a flexible bag having a spout. Sometimes this flexible bag and spout is positioned within an outer rigid container (such as a box), such packaging being termed bag in box packaging. In some instances, the box can be eliminated and the flexible bag may be a standalone component or may be incorporated into another package (such as a semi-rigid package, for example).

The flexible bag typically contains a flowable food product such as a liquid, a syrup, a juice, a gel or the like. In many configurations, a tap is coupled to the spout to allow for the selective dispensing of the flowable food product from within the bag. In other configurations, a cap may be positioned over the spout, wherein the cap includes a valve that can be actuated to control the egress of flowable food product. In still other configurations, a valve may be positioned within the spout, and the valve can be actuated by a dispenser coupled to the spout. The disclosure is not limited to any particular type of means of fluid withdrawal from the flexible bag.

In many instances, the flowable food product is sensitive to outside gasses and materials. For example, the flowable food product is susceptible to spoilage, and degradation in quality due to oxidation. Oxidation occurs when oxygen is transmitted through the bag, the spout and the tap of the flexible bag and is directed into the flowable food product. In instances where the flexible bag is used within the bag in box packaging, one particular flowable food product is a beverage that is susceptible to degradation from oxygen exposure, such as wine. Therefore, the shelf life of wine packaged in such bag in box packaging is often limited by the oxygen transmission rate of the flexible bag and its components. Decreasing the oxygen transmission rate serves to increase the shelf life of the wine within the bag in box package.

SUMMARY OF THE DISCLOSURE

The disclosure is directed to a barrier spout comprised of a straw and a sealboat. The straw comprises a first straw portion and a second straw portion, with an upper opening of the straw disposed at a first end of the first straw portion and a lower opening of the straw disposed at a second end of the second straw portion, the first straw portion and the second straw portion meeting at a second end of the first straw portion and a first end of the second straw portion. The straw is comprised of a barrier material to minimize at least one of oxygen and vapor transmission through the barrier material. The sealboat comprises a sealing material, the sealboat contacting an inner surface of the sealboat forming a liquid seal between the straw and the sealboat.

In some configurations, the first straw portion of the straw has a first inside and outside diameter and the second straw portion of the straw has a second inside and outside diameter, the first inside and outside diameter being larger than the second inside and outside diameter.

In some configurations, the barrier material is a coating on the outside surface of the straw.

In some configurations, the straw consists of the barrier material.

In some configurations, the barrier material is a resin.

In some configurations, the upper portion comprises threads proximate to the second end of the first straw portion.

In some configurations, the second straw portion comprises a snap fit ridge that is disposed at the second end of the second straw portion and encircles the second straw portion.

In some configurations, the straw further comprises a shot gate disposed at the second end of the second straw portion of the straw.

In some configurations, the sealboat comprising a shot gate disposed at the second end of the sealboat.

In some configurations, the straw further comprises at least one sealbead that circumscribes the outside surface of the second straw portion of the straw, the at least one sealbead disposed within at least one matching sealbead notch within an inside surface of the sealboard to form the liquid seal between the straw and the sealboat.

In some configurations, the sealboat comprises a pair of wing extensions.

In some configurations, the straw further comprises at least one snap fit disposed proximate to the second end of the first straw portion and the sealboat comprises at least one snap fit cutout proximate to the first end of the second straw portion.

In some configurations, the at least one snap fit comprises at least one cantilever boss disposed proximate to the second end of the first straw portion and the snap fit cutout further at least one cantilever cutout, the at least one cantilever boss flexing to snap into the at least one cantilever cutout to secure the straw to the sealboat.

In some configurations, the at least one snap fit comprises at least one cylindrical undercut disposed proximate to the second end of the first straw portion and the at least one snap fit cutout comprises at least one cylindrical undercut cutout, the at least one cylindrical undercut snapping into the at least one cylindrical undercut cutout to secure the straw to the sealboat.

In some configurations, the straw and sealboat are formed via a 2-shot molding process wherein the sealboat is molded over the straw to form the liquid seal between the straw and the sealboat.

In some configurations, the 2-shot molding process is one of rotary/transfer 2-shot molding and overmolding.

In some configurations, the barrier material is at least one of Polybutylene terephthalate (PBT), a barrier nylon, Ethylene vinyl alcohol (EVOH), a barrier resin, and a barrier plastic.

BRIEF DESCRIPTION OF THE DRAWINGS

The disclosure will now be described with reference to the drawings wherein.

DETAILED DESCRIPTION OF THE DISCLOSURE

Figure 1:
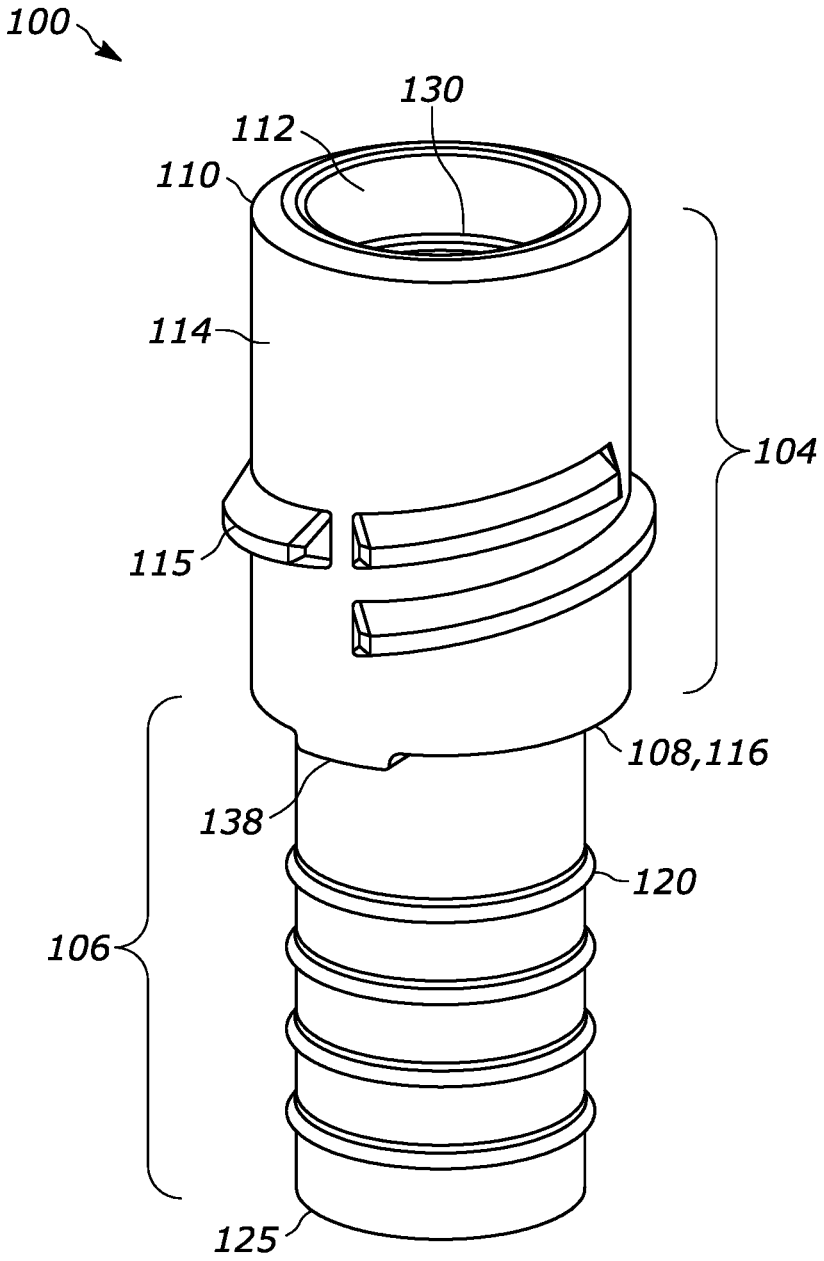
FIG. 1 of the drawings illustrates a perspective view of an example straw, in accordance with at least one possible embodiment.

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Currently pouch style fitments and bag in a boxused in the market today have limitations when it comes to barrier properties and resistance to oxygen and moisture/vapor transmission. This is due to the fact that most pouch style fitments, including those for bag in box packaging, are produced with a material such as polyethylene, or other similar types of material. This is common place due to a need for competitive costing as well as sealability to the pouch film structures & materials. Polyethylene, or other similar types of materials, does not have very good oxygen and vapor resistance properties which are the primary causes of spoilage of product within the pouch or bag.

The biggest portion of exposed polyethylene, or other similar types of materials, and subsequent source of oxygen/vapor transmission within the pouch is the spout, due to the spout having a large exposed surface area of polyethylene, or other similar types of materials. The film structure can have barrier materials added to it and the cap has a small percentage of exposed surface area. More specifically, within the spout the biggest portion of exposed polyethylene is the "straw" or cylindrical portion of the spout. This is because the area below or the "sealboat" has the film with barrier protection sealed to it.

The embodiments address this problem by making the spout with at least two pieces instead of the more common industry practice of one piece. The at least two pieces comprise the straw and the sealboat. The straw is comprised of a high barrier resistant material to improve oxygen and vapor transmission whereas the sealboat is still be made of an inexpensive sealing material so that the sealboat can be sealed to the film.

Figure 2:
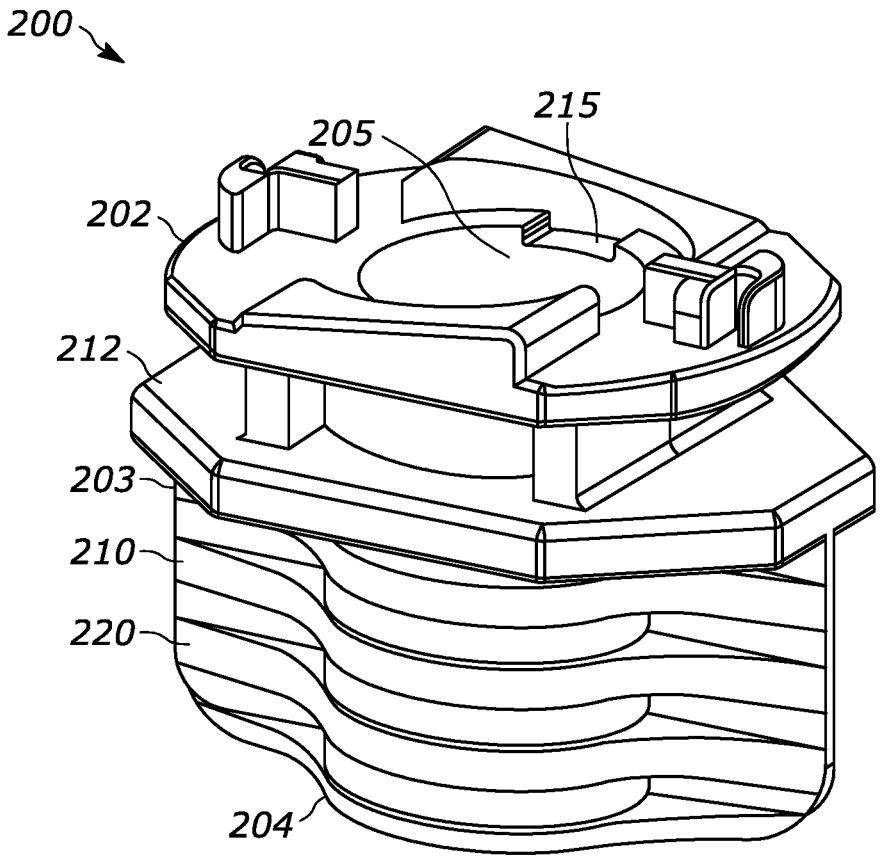
FIG. 2 of the drawings illustrates a perspective view of an example sealboat, in accordance with at least one possible embodiment.

Referring now to the drawings, a barrier spout 300 (FIG. 3) is comprised of a straw 100 (FIG. 1) mated to a sealboat 200 (FIG. 2). The straw 100 is comprised of a first straw portion 104 and a second straw portion 106. An upper opening 112 of the straw 100 is disposed at a first end 110 of the first straw portion 104 and a lower opening 135 of the straw 100 is disposed at a second end 125 of the second straw portion 106. In some embodiments, the first end 110 can be rounded, as shown. In other embodiments, the first end 110 can be squared, pointed, wedged, etc. The first straw portion 104 and the second straw portion 106 meeting at a second end 108 of the first straw portion 104 and a first end 116 of the second straw portion 106. An inside surface 118 of the straw 100 is cylindrical from the first end 110 of the straw 100 to the second end 125 of the straw 100.

The straw 100 is comprised of a barrier material to minimize at least one of oxygen and vapor transmission through the barrier material of the straw 100. In some embodiments, the barrier material can be comprised of Polybutylene terephthalate (PBT), a barrier nylon, Ethylene vinyl alcohol (EVOH), a barrier resin, a barrier plastic, or any other barrier material that minimizes at least one of oxygen and vapor transmission through the barrier material of the straw 100. In some embodiments, the barrier material is a coating on an outside surface 114 of the straw 100. In other embodiments, the straw 100 consists entirely of the barrier material. In yet some other embodiments, only the internal and external portion of the straw 100 that is exposed to the at least one of oxygen and vapor is comprised of the barrier material.

Figure 4:
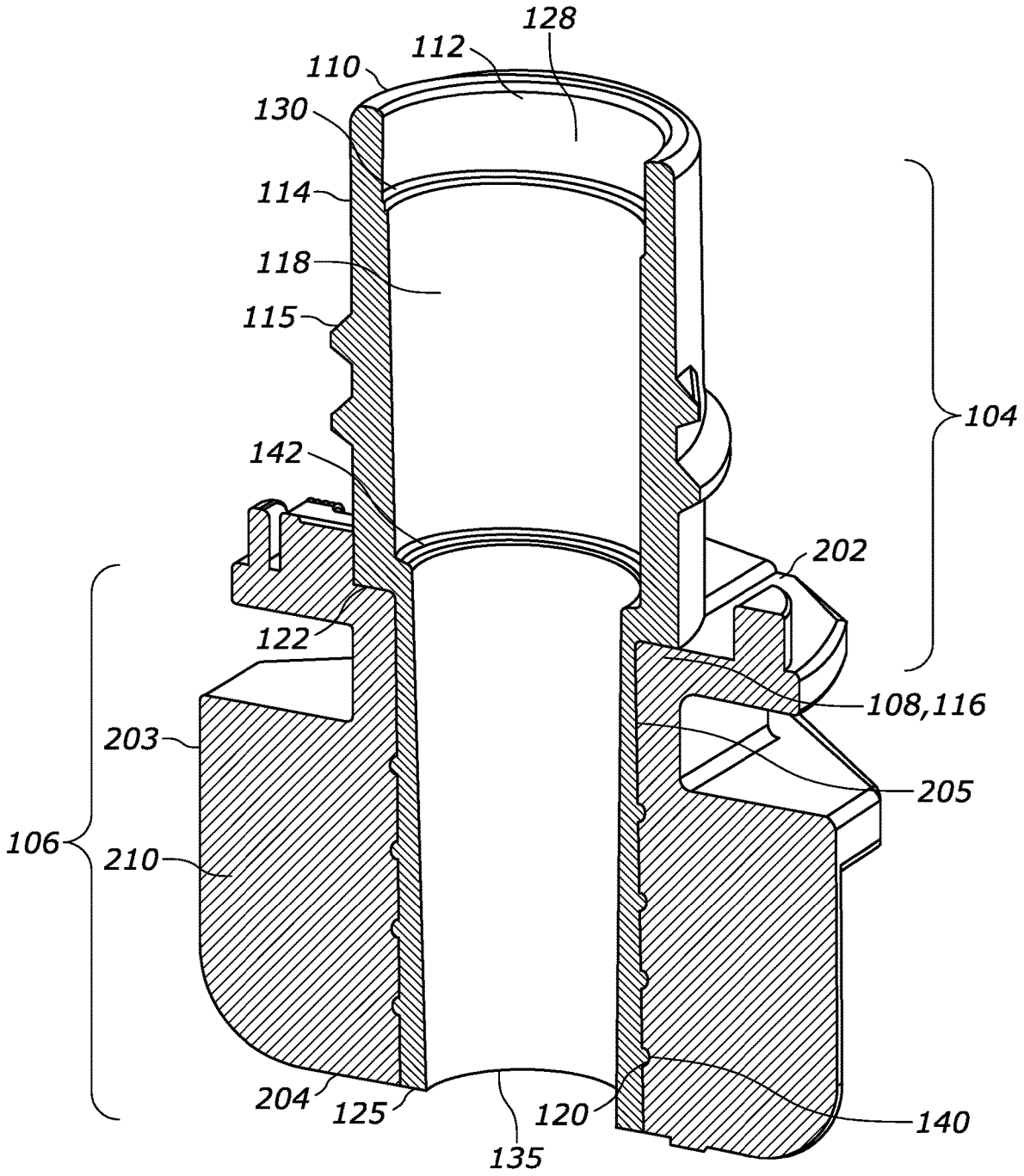
FIG. 4 of the drawings illustrates a perspective cross-sectional view of the example coupled straw and sealboat illustrated in FIG. 3, in accordance with at least one possible embodiment.

In some embodiments, the first straw portion 104 of the straw 100 has an inside and outside diameter that is larger than an inside and outside diameter of the second straw portion 106 of the straw 100. Such differing diameters form an edge 122 (FIG. 4) on the outside surface 114 of the straw 100 where the first straw portion 104 and the second straw portion 106 meet. Although the edge 122 is illustrated as being a perpendicular edge to the outside surface 114 of the straw 100, in other embodiments the edge 122 can be rounded, chamfered, filleted, or any other shape that provides a mating surface for the straw 100 and the sealboat 200. Corresponding to the edge 122 is another edge 142 (FIG. 4) on the inside surface 118 of the straw 100, the edge 142 being perpendicular to the inside surface 118 of the straw 100. Like the edge 122, the edge 142 can be can be rounded, chamfered, filleted, or any other shape that provides a transition between the differing diameters of the first straw portion 104 and the second straw portion 106.

In some embodiments, the first straw portion 104 can further include widened portion 128 (FIG. 4) that is proximate to the upper opening 112 of the straw 100. In the example shown, the widened portion 128 accounts for approximately the upper quarter of the length of the first straw portion 104 from the first end 110 of the straw 100, the widened portion 128 having a greater diameter than the remainder of the first straw portion 104. At the point where the widened portion 128 widens from the remainder of the first straw portion 104 is a tapered region 130. In other embodiments, the tapered region 130 can be can be rounded, chamfered, filleted, or any other shape that provides a transition between the differing diameters of the first straw portion 104.

In some embodiments, the first straw portion 104 includes threads 115 disposed on the outside surface 114 thereof. The threads 115 are disposed proximate to the second end 108 of the first straw portion 104. The threads 115 accept a cap (not shown) tightened thereon to prevent a liquid from escaping through the upper opening 112 of the straw 100. The threads 115 can be comprised of one continuous thread or a plurality of broken thread segments, as shown.

Figure 3:
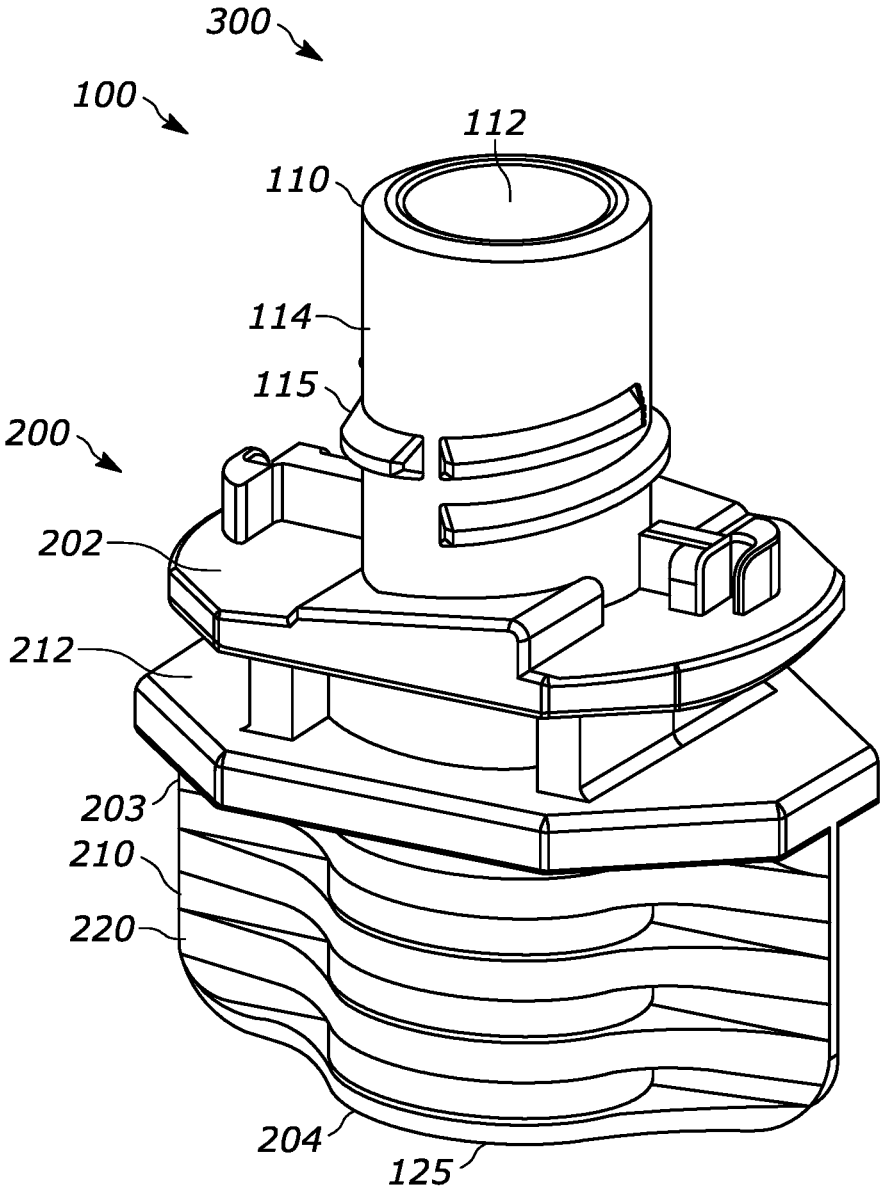
FIG. 3 of the drawings illustrates a perspective view of the example straw of FIG. 1 coupled to the example sealboat of FIG. 2 forming a barrier spout, in accordance with at least one possible embodiment.

The sealboat 200 is comprised of a sealing material, such as High-density polyethylene (HDPE), or any other sealing material. The sealboat 200 includes a first end 202 and a second end 204. An inner cylindrical surface 205 of the sealboat 200 contacts an outside surface 114 of the straw 100 to form a liquid seal between the sealboat 200 and the straw 100. A pouch (not shown) or film (not shown) is typically disposed where the second end 108 of the first straw portion 104 contacts the first end 202 of the sealboat 200 when the straw 100 and sealboat 200 are mated, as shown in FIG. 3.

In some embodiments, the straw 100 further comprises at least one sealbead 120 that circumscribes the outside surface 114 of the second straw portion 106 of the straw 100. When the straw 100 and sealboat 200 are mated, the at least one sealbead 120 is disposed within at least one matching sealbead notch 140 (FIG. 4) along the inner cylindrical surface 205 of the sealboat 200 to form the liquid seal between the straw 100 and the sealboat 200. In the example shown, the straw 100 includes four (4) sealbeads 120 and, likewise, sealbead notches 140. However, the straw 100 and sealboat 200 can include more or less sealbeads 120 and matching sealbead notches 140, dependent upon the application of the barrier spout 300.

In some embodiments, the sealboat 200 is further comprised of a pair of wing extensions 210 that extend from the second end 204 of the sealboat 200 to approximately a midpoint 203 of the sealboat 200, although other locations are possible. The pair of wing extensions 210 extend from an area proximate to the outside surface 114 of the straw 100 perpendicular to the straw 100 to provide a surface to grasp the barrier spout 300. In some embodiments, the pair of wing extensions 210 include ribs 220 that extend across both the pair of wing extensions 210 perpendicular to the inner cylindrical surface 205 to add strength to the pair of wing extensions 210.

In some embodiments, the sealboat 200 further includes a finger stop element 212. The finger stop element 212 is disposed against the pair of wing extensions 210 opposite a side of pair of wing extensions 210 proximate to the second end 204 of the sealboat 200. The finger stop element 212 allows force to be applied to the sealboat 200 against the finger stop element 212 to couple the sealboat 200 to the straw 100.

In some embodiments the straw 100 and the sealboat 200 are coupled after being separately manufactured. In one such embodiment, the straw 100 can include at least anti-rotation tab to couple the straw 100 to the sealboat 200. An example of such an anti-rotation tab is the pair of anti-rotation tab santi-rotation tabs 138 disposed proximate to second end 108 of the first straw portion 104. The pair of anti-rotation tabsanti-rotation tabs 138 are tab shaped undercuts that extend slightly past the second end 108 of the first straw portion 104. Corresponding in shape to the pair of anti-rotation tabsanti-rotation tabs 138 is are a pair of anti-rotation tab cutouts 215 on the sealboat 200, such that the pair of anti-rotation tabsanti-rotation tabs 138 fit into the pair of anti-rotation tab cutouts 215, respectively. The pair of anti-rotation tab cutouts 215 are disposed along the inner cylindrical surface 205 at the first end 202 of the sealboat 200. When coupling the straw 100 to the sealboat 200, the pair of anti-rotation tabs 138 snap into the pair of anti-rotation tab cutouts 215 to secure the straw 100 to the sealboat 200. Although two anti-rotation tabs 138 and two anti-rotation tab cutouts 215 are illustrated on opposite sides of the straw 100 and the sealboat 200, respectively, any number of anti-rotation tabs 138 and anti-rotation tab cutouts 215 can utilized and positioned as desired to provide a secure coupling of the straw 100 and the sealboat 200.

Figure 5:
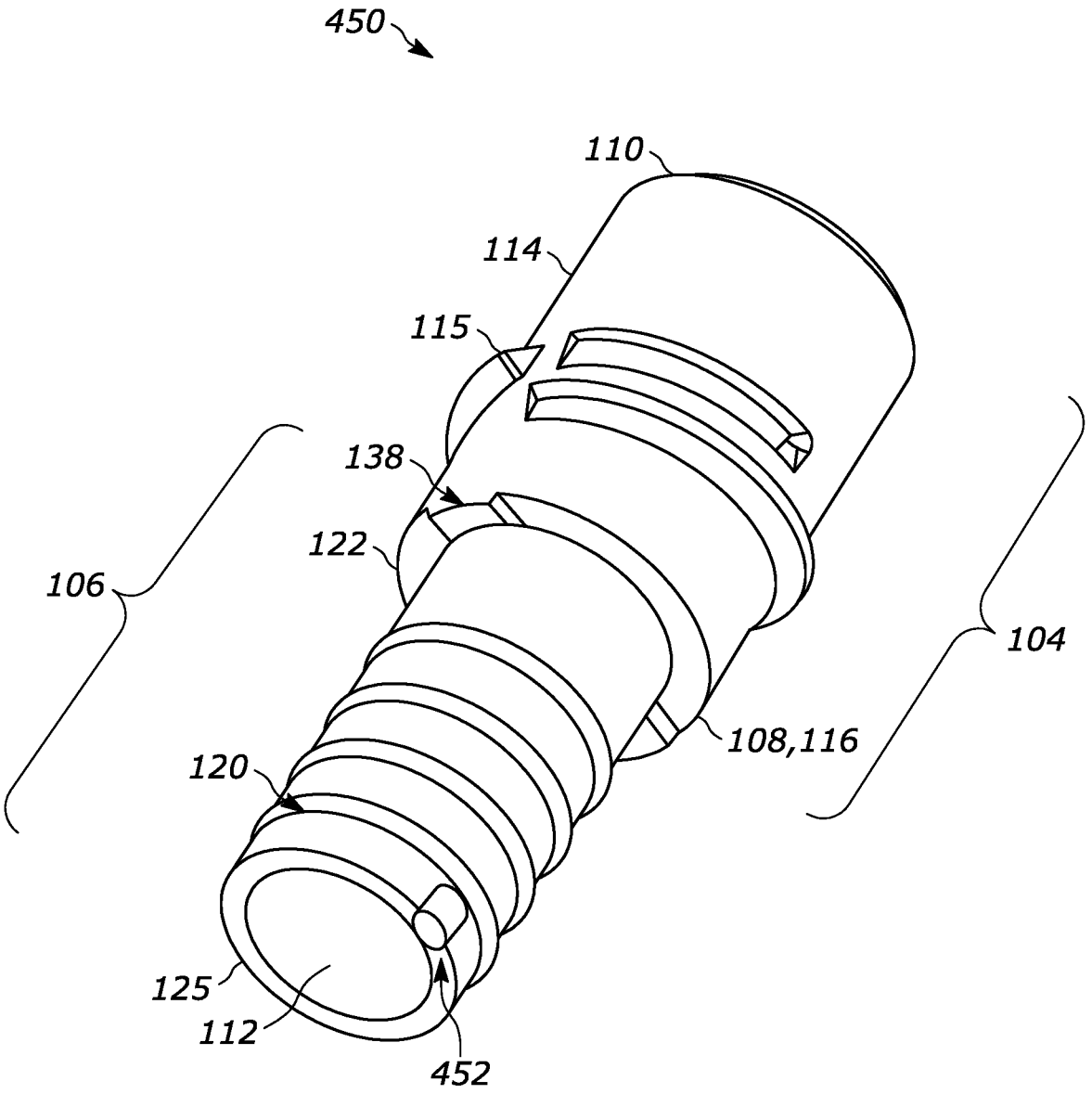
FIG. 5 of the drawings illustrates a perspective view of another example straw, in accordance with at least one possible embodiment.
Figure 6:
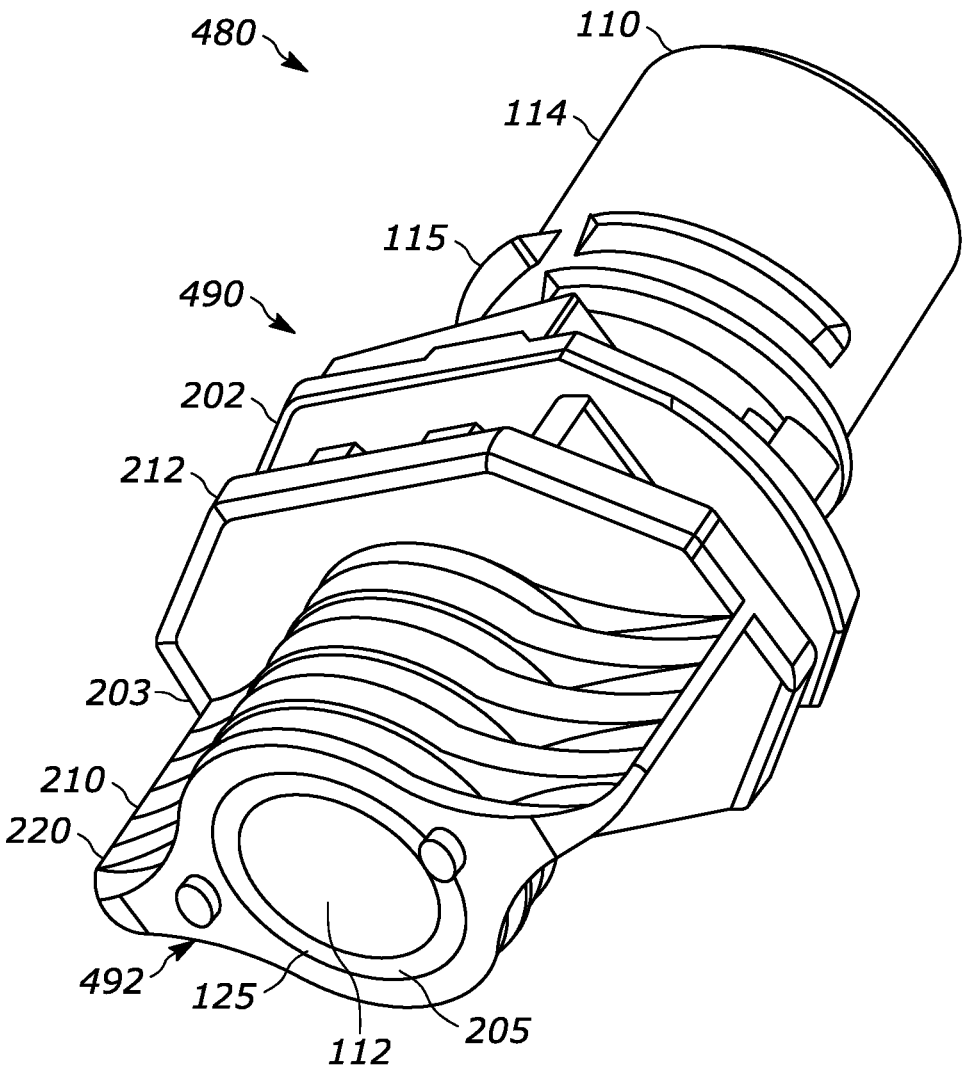
FIG. 6 of the drawings illustrates another perspective view of the example straw of FIG. 1 coupled to the example sealboat of FIG. 2 another barrier spout, in accordance with at least one possible embodiment.
Figure 7:
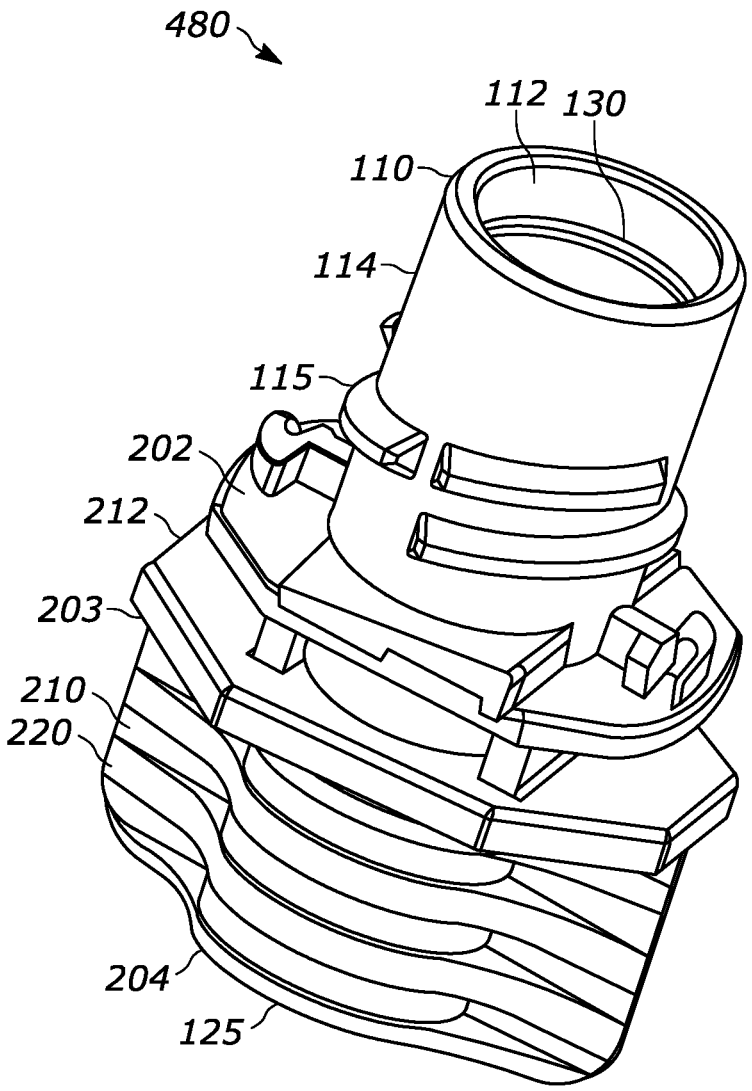
FIG. 7 of the drawings illustrates another perspective view of the example straw of FIG. 1 coupled to the example sealboat of FIG. 2, in accordance with at least one possible embodiment.

FIG. 5 of the drawings illustrates a perspective view of another example straw 450. In this example, the barrier spout 480 (FIG. 6) is manufactured via a 2-shot molding process. The straw 450 is first molded, for example with rotary/transfer 2-shot molding or overmolding. A first shot gate 452 is formed along the second end 125 of the straw 450 during this molding process. Thereafter, a sealboat 490 is molded, for example with rotary/transfer 2-shot molding or overmolding. A second shot gate 492 is formed along the second end 204 of the sealboat 490 during this molding process. The sealboat 490 is molded over the straw 480 forming a liquid tight mechanical bond between the straw 450 and the sealboat 490.

Figure 8:
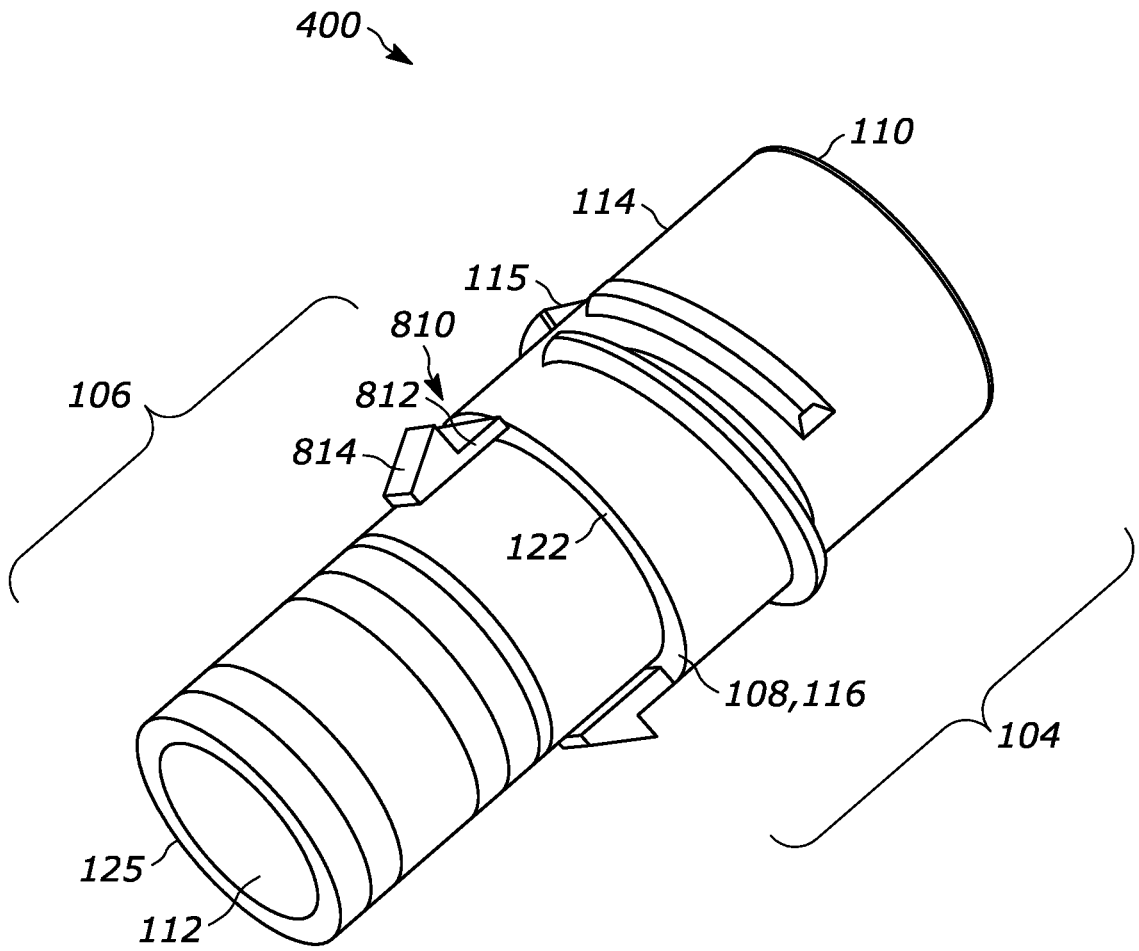
FIG. 8 of the drawings illustrates a perspective view of another example straw, in accordance with at least one possible embodiment.

FIG. 8 of the drawings illustrates a perspective view of another example straw 400. In this example, the straw 400 includes many of the same features described above and as shown. However, straw 400 utilizes a different type of snap fit than that used by straw 100. Straw 400 utilizes a pair of cantilever bosses 810 that extend from the second end 108 of the first straw portion 104. Each of the cantilever bosses 810 includes an elongated portion 812 and a wedged portion 814. The elongated portion 812 is coupled at one end to the second end 108 and the other non-coupled end of the elongated portion 812 includes the wedged portion 814.

Figure 9:
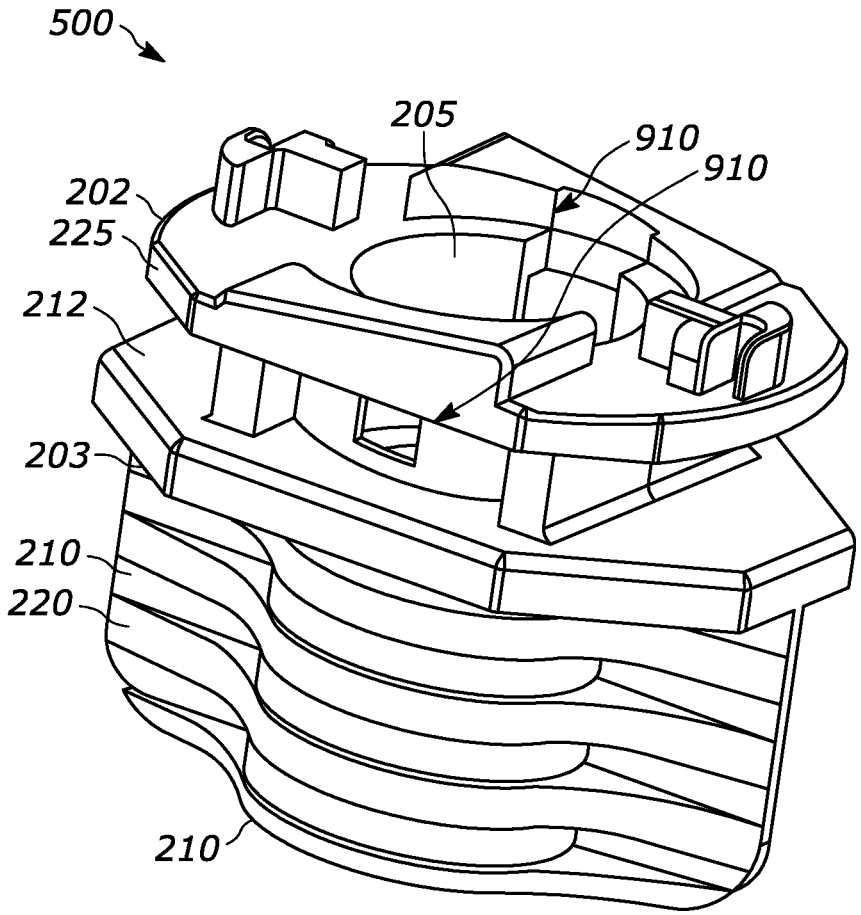
FIG. 9 of the drawings illustrates a perspective view of another example sealboat, in accordance with at least one possible embodiment.
Figure 10:
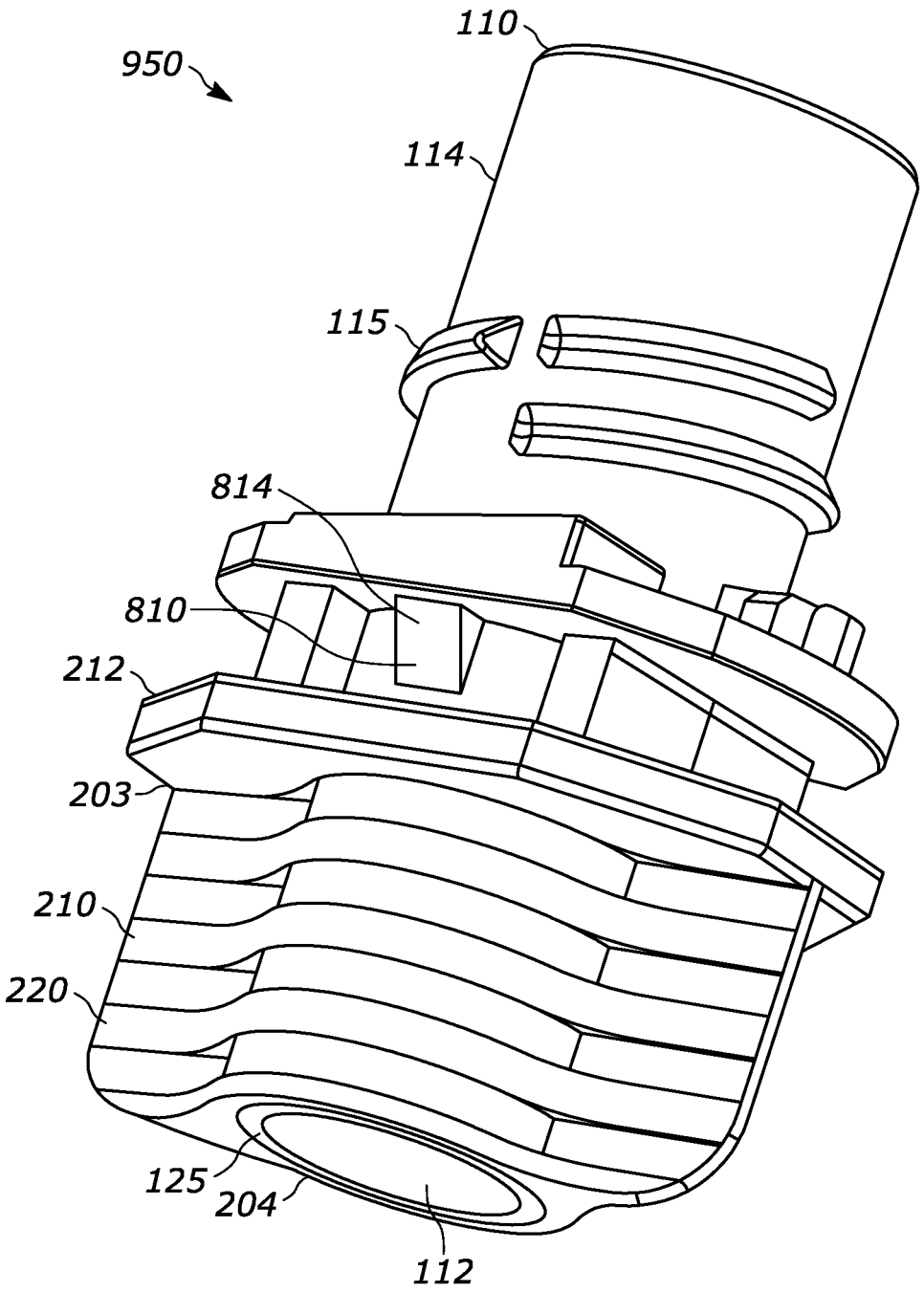
FIG. 10 of the drawings illustrates a perspective view of the example straw of FIG. 8 coupled to the example sealboat of FIG. 9 forming yet another barrier spout, in accordance with at least one possible embodiment.
Figure 11:
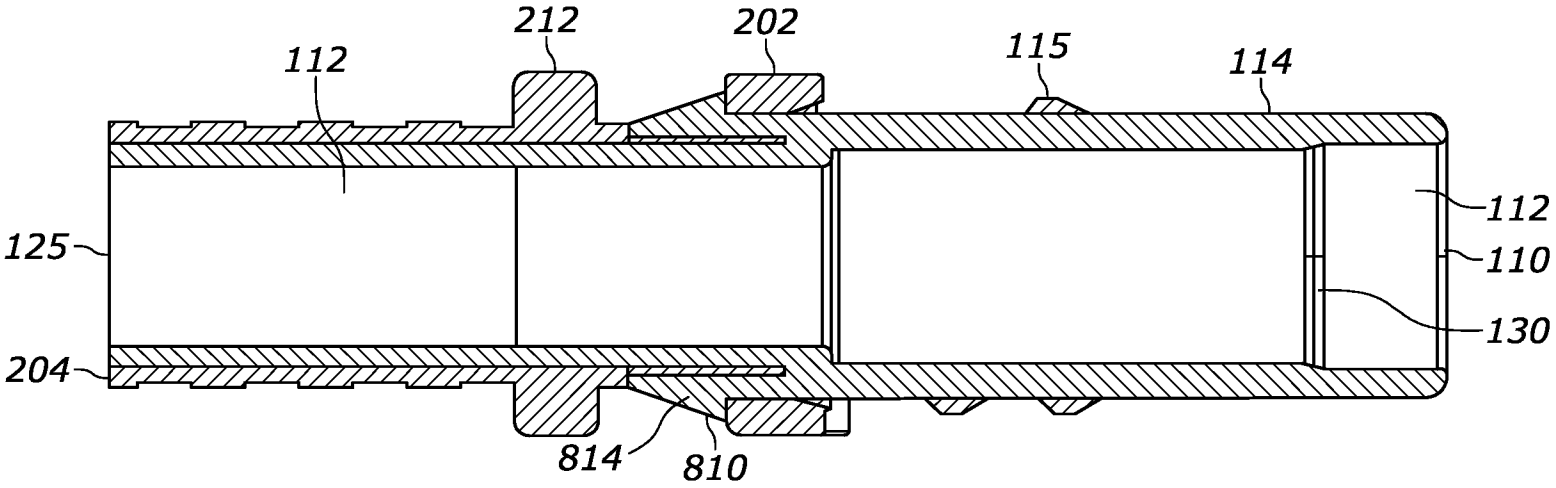
FIG. 11 of the drawings illustrates a cross-sectional view of the example barrier spout illustrated in FIG. 10, in accordance with at least one possible embodiment.

Another type of sealboat, sealboat 500 (FIG. 9) includes a pair of cantilever cutouts 910 at the first end 202 of the sealboat 500. Corresponding in shape to the cantilever bosses 810 are the pair of cantilever cutouts 910. The pair of cantilever cutouts 910 are disposed along the inner cylindrical surface 205 at the first end 202 of the sealboat 500. The pair of cantilever bosses 810 flex to snap the wedged portion 814 thereof into the pair of cantilever cutouts 910 to secure the straw 400 to the sealboat 500. Although two cantilever bosses 810 and two cantilever cutouts 910 are illustrated on opposite sides of the straw 400 and the sealboat 500, respectively, any number of cantilever bosses 810 and cantilever cutouts 910 can utilized and positioned as desired to provide a secure coupling of the straw 400 and the sealboat 500. FIG. 10 of the drawings illustrates a perspective view of the example straw 400 of FIG. 8 coupled to the example sealboat 500 of FIG. 9 forming a barrier spout 950. FIG. 11 of the drawings illustrates a cross-sectional view of the example barrier spout 950 illustrated in FIG. 10.

Figure 12:
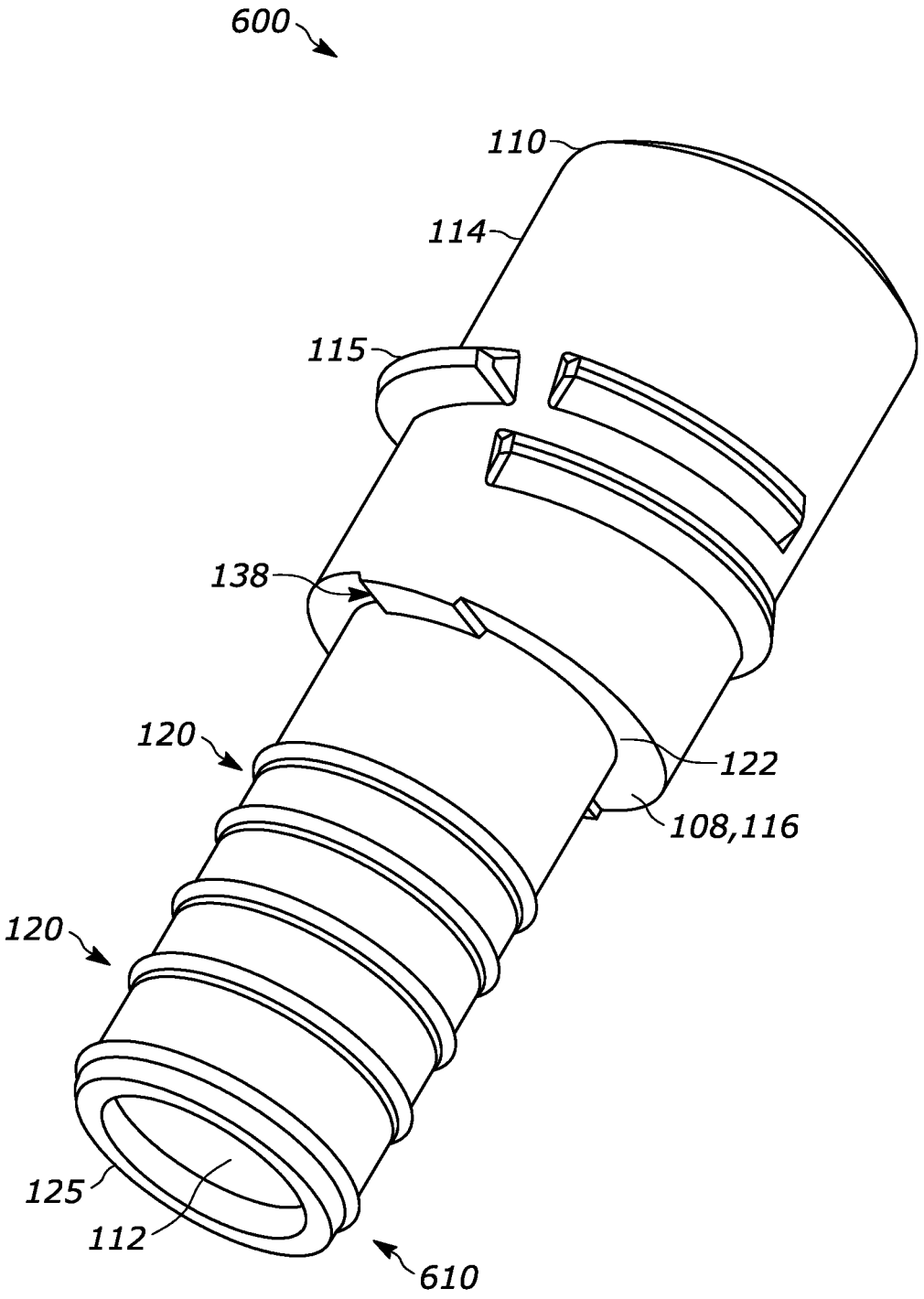
FIG. 12 of the drawings illustrates a perspective view of yet another example straw, in accordance with at least one possible embodiment.
Figure 13:
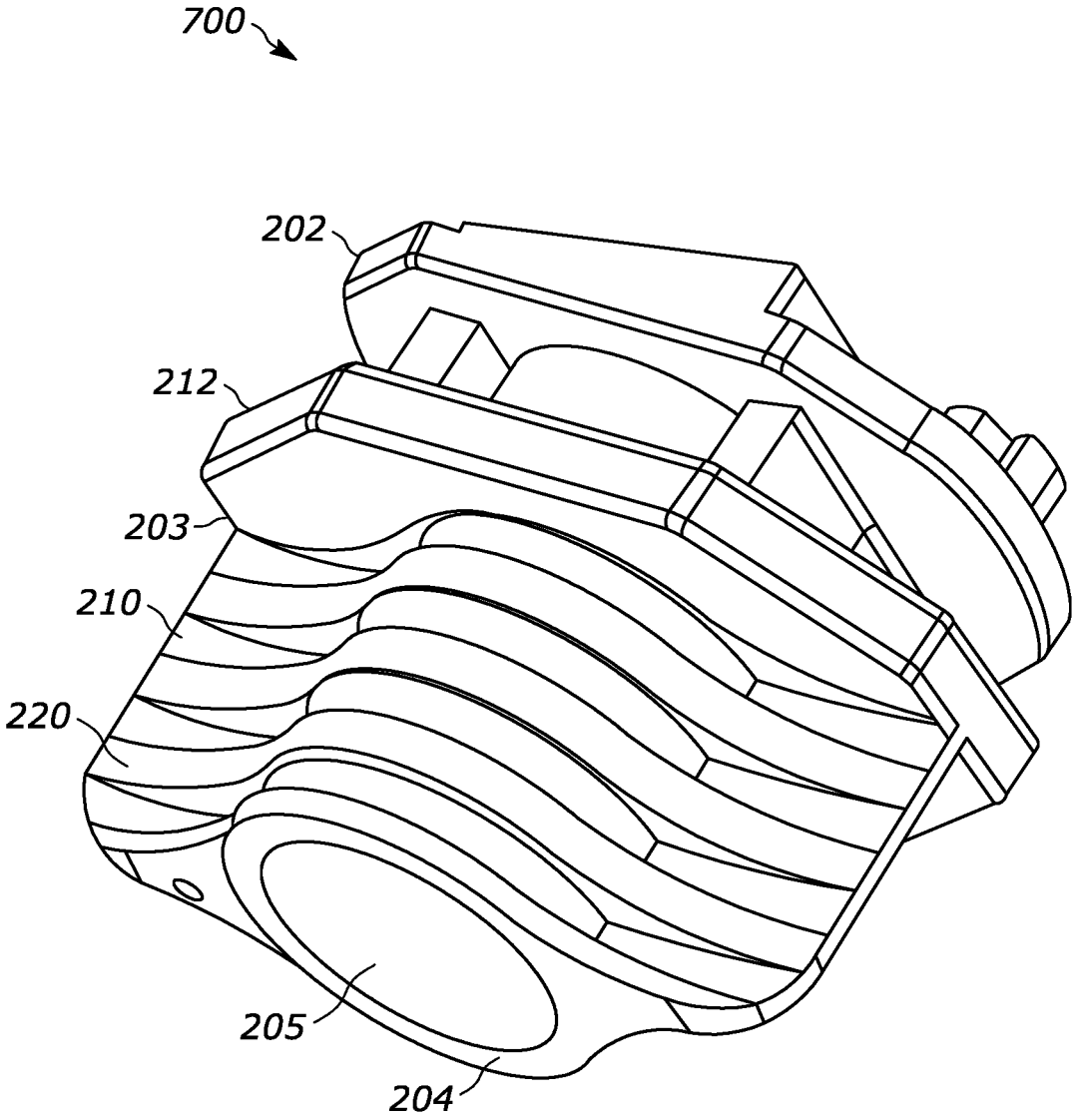
FIG. 13 of the drawings illustrates a perspective view of yet another example sealboat, in accordance with at least one possible embodiment.
Figure 14:
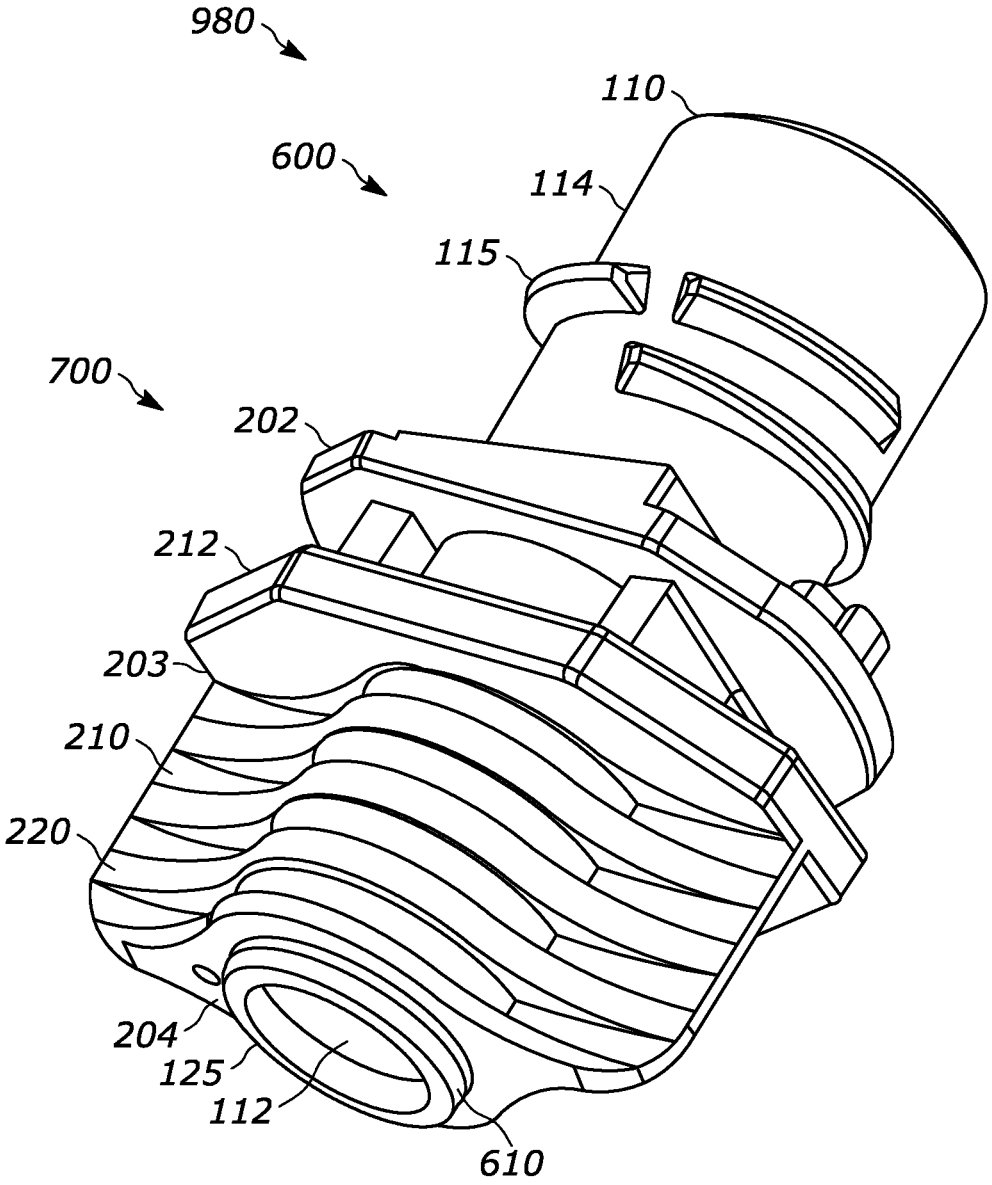
FIG. 14 of the drawings illustrates another perspective view of the example straw of FIG. 12 coupled to the example sealboat of FIG. 13 forming even another barrier spout, in accordance with at least one possible embodiment.
Figure 15:
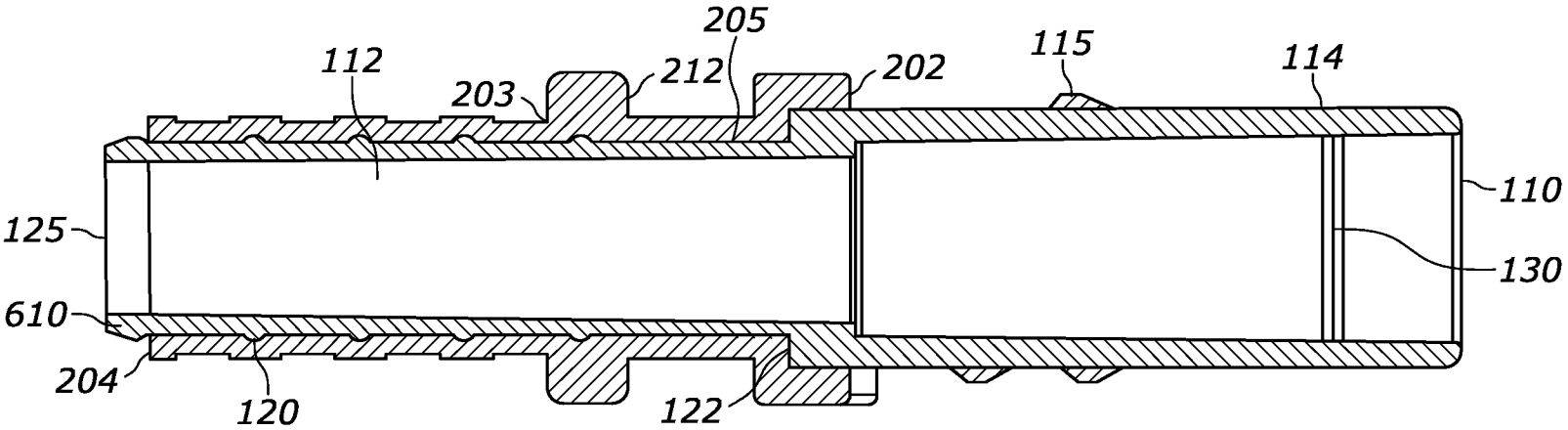
FIG. 15 of the drawings illustrates a cross-sectional view of the example coupled straw and sealboat illustrated in FIG. 14, in accordance with at least one possible embodiment.

FIG. 12 of the drawings illustrates a perspective view of yet another example straw 600. In this example, the straw 600 includes many of the same features described above and as shown. However, straw 600 utilizes a different type of snap fit than that used by straw 100. Straw 600 utilizes a snap fit ridge 610. The second straw portion 106 comprises the snap fit ridge 610 that is disposed at the second end 125 of the second straw portion 106 and encircles the second straw portion 106. Corresponding to the straw 600 is a sealboat 700. The sealboat 700 appears similar to sealboats 200 and 500, however the height of the sealboat 700 from the first end 202 to the second end 204 is slightly less than sealboats 200 and 500 such that when straw 600 and sealboat 700 are coupled (FIG. 14), the snap fit ridge 610 extends beyond the second end 204 of the sealboat 700 and puts pressure against the second end 204 of the sealboat 700 to securely couple the sealboat 700 to the straw 600. In some embodiments, the edge of the snap fit ridge 610 is angled, such as chamfered or rounded, to allow the sealboat 700 to more easily be slid onto the straw 600. FIG. 14 of the drawings illustrates another perspective view of the example straw 600 of FIG. 12 coupled to the example sealboat 700 of FIG. 13 forming a barrier spout 980.

Through testing, it has been found that a conventional High-density polyethylene (HDPE) spout and HDPE cap have an oxygen transmission rate of approximately 0.4728 cc/pkg/day@100% $O_2$. With the barrier spout of the present disclosure utilizing an PBT spout and an HDPE cap, the oxygen transmission can be reduced to 0.0075 cc/pkg/day@100% $O_2$. With the barrier spout of the present disclosure utilizing a nylon spout and an HDPE cap, the oxygen transmission can be reduced to 0.0070 cc/pkg/day@100% $O_2$. With the barrier spout of the present disclosure utilizing an EVOH spout and an HDPE cap, the oxygen transmission can be reduced to 0.0038 cc/pkg/day@100% $O_2$. Such reductions translate to a substantial extension of the shelf life of perishable products, e.g., wine, within a flexible bag utilizing the barrier spout disclosed.

The foregoing description merely explains and illustrates the invention and the invention is not limited thereto except insofar as the appended claims are so limited, as those skilled in the art who have the disclosure before them will be able to make modifications

What is claimed is:

1. A barrier spout, comprising:

a straw comprising a first straw portion and a second straw portion, with an upper opening of the straw being disposed at a first end of the first straw portion and a lower opening of the straw being disposed at a second end of the second straw portion, the first straw portion and the second straw portion meeting at a second end of the first straw portion and a first end of the second straw portion, the straw further comprising a barrier material to minimize at least one of oxygen and vapor transmission through the barrier material of the straw, wherein the first straw portion of the straw has a first inside and outside diameter and the second straw portion of the straw has a second inside and outside diameter, the first inside and outside diameter being larger than the second inside and outside diameter; and a sealboat comprising a sealing material, with an inner surface of the sealboat contacting an outer surface of the straw forming a liquid seal between the sealboat and the straw.

2. The barrier spout of claim 1, wherein the barrier material is a coating on the outside surface of the straw.

3. The barrier spout of claim 1, wherein the straw consists of the barrier material.

4. The barrier spout of claim 1, wherein the barrier material is a resin.

5. The barrier spout of claim 1, wherein the first straw portion further comprises threads proximate to the second end of the first straw portion.

6. The barrier spout of claim 1, wherein the second straw portion comprises a snap fit ridge that is disposed at the second end of the second straw portion and encircles the second straw portion.

7. The barrier spout of claim 1, wherein the straw further comprises a shot gate disposed at the second end of the second straw portion of the straw.

8. The barrier spout of claim 1, wherein the sealboat comprising a shot gate disposed at a second end of the sealboat.

9. The barrier spout of claim 1, wherein the straw further comprises at least one sealbead that circumscribes the outside surface of the second straw portion of the straw, the at least one sealbead disposed within at least one matching sealbead notch within an inside surface of the sealboat to form the liquid seal between the straw and the sealboat.

10. The barrier spout of claim 1, wherein the sealboat comprises a pair of wing extensions.

11. A barrier spout, comprising:

a straw comprising a first straw portion and a second straw portion, with an upper opening of the straw being disposed at a first end of the first straw portion and a lower opening of the straw being disposed at a second end of the second straw portion, the first straw portion and the second straw portion meeting at a second end of the first straw portion and a first end of the second straw portion, the straw further comprising a barrier material to minimize at least one of oxygen and vapor transmission through the barrier material of the straw;

a sealboat comprising a sealing material, with an inner surface of the sealboat contacting an outer surface of the straw forming a liquid seal between the sealboat and the straw, wherein the straw further comprises at least one snap fit disposed proximate to the second end of the first straw portion and the sealboat comprises at least one snap fit cutout proximate to the first end of the second straw portion.

12. The barrier spout of claim 11, wherein the at least one snap fit comprises at least one cantilever boss disposed proximate to the second end of the first straw portion and the snap fit cutout further at least one cantilever cutout, the at least one cantilever boss flexing to snap into the at least one cantilever cutout to secure the straw to the sealboat.

13. The barrier spout of claim 11, wherein the at least one snap fit comprises at least one cylindrical undercut disposed proximate to the second end of the first straw portion and the at least one snap fit cutout comprises at least one cylindrical undercut cutout, the at least one cylindrical undercut snapping into the at least one cylindrical undercut cutout to secure the straw to the sealboat.

14. The barrier spout of claim 1, wherein the straw and sealboat are formed via a 2-shot molding process wherein the sealboat is molded over the straw to form the liquid seal between the straw and the sealboat.

15. The barrier spout of claim 14, wherein the 2-shot molding process is one of rotary/transfer 2-shot molding and overmolding.

16. The barrier spout of claim 1, wherein the barrier material is at least one of Polybutylene terephthalate (PBT), a barrier nylon, Ethylene vinyl alcohol (EVOH), a barrier resin, and a barrier plastic.

* * * * *